US006639484B2

(12) United States Patent
Tzuang et al.

(10) Patent No.: US 6,639,484 B2
(45) Date of Patent: Oct. 28, 2003

(54) PLANAR MODE CONVERTER USED IN PRINTED MICROWAVE INTEGRATED CIRCUITS

(75) Inventors: Ching-kuang Tzuang, Hsin Chu (TW); Cheng-jung Lee, Hsin Chu (TW)

(73) Assignee: National Chiao Tung University (TW)

( * ) Notice: Subject to any disclaimer, the term of this patent is extended or adjusted under 35 U.S.C. 154(b) by 0 days.

(21) Appl. No.: 10/165,547

(22) Filed: Jun. 7, 2002

(65) Prior Publication Data

US 2003/0080822 A1 May 1, 2003

(30) Foreign Application Priority Data

Nov. 1, 2001 (TW) ..... 90127359 A

(51) Int. Cl.[7] ..... H01P 1/16

(52) U.S. Cl. ..... 333/21 R; 333/34; 333/26; 333/33

(58) Field of Search ..... 333/21 R, 26, 333/33, 34, 128, 204, 218

(56) References Cited

U.S. PATENT DOCUMENTS 3,969,691 A * 7/1976 Saul ..... 333/21 R
4,124,823 A * 11/1978 Sechi ..... 333/21 R
4,636,757 A * 1/1987 Harrison et al. ..... 333/21 R
5,311,153 A * 5/1994 Lau et al. ..... 333/26
5,867,073 A * 2/1999 Weinreb et al. ..... 333/26
6,573,803 B1 * 6/2003 Ziegner et al. ..... 333/26

* cited by examiner

*Primary Examiner*—Michael Tokar
*Assistant Examiner*—Lam Mai
(74) *Attorney, Agent, or Firm*—Martine & Penilla, LLP

(57) ABSTRACT

A planar mode converter includes a rectangular waveguide, a microstrip feed-in circuit, and a microstrip feed-out circuit. The rectangular waveguide is filled with dielectric layers and surrounded with metal materials. The lowermost dielectric layer has usually largest thickness and dielectric constant. Except for the lowermost dielectric layer, each of the dielectric layers has a rectangular aperture at its front-end and back-end, respectively. The microstrip feed-in circuit is constituted by first, second and third metal strips, and a feed-in metal ground plane. The first metal strip and the feed-in metal ground plane form a feed-in signal line. The first, second and third metal strips are adhered to the top surface of the lowermost dielectric layer, and the feed-in metal ground plane is adhered to the bottom surface of the lowermost dielectric layer. The microstrip feed-out circuit is constituted of fourth, fifth and sixth metal strips, and a feed-out metal ground plane. The sixth metal strip and the feed-out metal strip form a feed-out signal line.

21 Claims, 8 Drawing Sheets

PLANAR MODE CONVERTER USED IN PRINTED MICROWAVE INTEGRATED CIRCUITS

BACKGROUND OF THE INVENTION

1. Field of the Invention

The invention relates to a planar mode converter used in printed microwave integrated circuits, and more particularly, to a planar mode converter with low transmission losses and a simple fabrication process, utilized for printed microwave integrated circuits.

2. Description of the Related Art

Coupled with the flourishing of wireless communication during the recent years, printed integrated circuits with characteristics such as small in size, light in weight, low production cost and adapted to mass production, have become one of the important techniques in the fabrication of communication modules. However, confronting with wireless communication systems in which microwave and millimeter bands are applied, planar printed circuits, such as microstrips and coplanar waveguides, the shortcoming of the planar printed circuit technique due to comparatively larger transmission losses is explicitly exposed. Therefore, for radio front-end modules that are getting more and more stringent and complex day by day, it is an arduous challenge to depend solely on conventional microwave and millimeter wave planar printed circuit techniques in the fabrication process. Hence, in order to minimize energy consumption and enhance system performance, non-radiative dielectric (NRD) guides and rectangular waveguides are widely used to replace certain planar printed integrated circuits and are applied to millimeter wave or higher bands because of their low transmission losses property, thus becoming one of the main-stream guiding structures for high performance band modules. During the past twenty years, Yoneyama et al. have invented the non-radiative dielectric(NRD) guide 10 by inserting a dielectric strip 13, represented as the rectangular dielectric rod 13 in FIG. 1 into a parallel-plate metal waveguide 11 so that signals are propagated in the dielectric rod without radiating energy. Yoneyama et al. in the meanwhile analyzed the characteristics of non-radiative dielectric guide and derived numerous related applications, including transmitter-receiver modules and array antennas.

Referring to FIG. 2, as another application structure that has low power losses and has been proficiently used, as disclosed in the U.S. Pat. No. 6,127,901, a rectangular waveguide 20 is shown. However, its structure is non-planar and therefore many interface converters are developed so that the rectangular waveguide 20 can be integrated with planar active or passive components. For instance, a planar microstrip 21 in FIG. 2 is integrated with the rectangular waveguide 20 by a square aperture 22. The known converters in the present time are classified into four categories below:

1. A broadband coplanar-strips quasi-yagi antenna similar to outdoor television antennas is made by using a printed circuit board, which is then inserted into the E-plane of the metal waveguide. The radiation pattern of the antenna is then able to correspond with the pattern of the dominant mode ($TE_{10}$) of the rectangular waveguide, in a way that the energy is propagated by the dominant mode of the waveguide instead of the microstrip. The antenna has been disclosed both in "A systematic optimum design of waveguide-to-microstrip transition," IEEE trans. Microwave Theory Tech., vol. 45, no.5, May 1997, written by H. B. Lee and T. ltoh, and "A Broad-band microstrip-to-waveguide transition using quasi-yagi antenna," IEEE trans. Microwave Theory Tech., vol. 47, no. 12,pp. 2562–2567, December 1999, written by N. Kaneda, Y. Qian and T. ltoh,. The disclosures are incorporated herein by reference.
2. A patch antenna made by using printed circuit board is placed upon the E-plane of the rectangular waveguide. Then, the propagation energy on the microstrip is coupled into the rectangular waveguide by implementing the aperture-coupling concept so that the patch antenna radiates and further stimulates the dominant mode of the rectangular waveguide, thus completing the mode conversion. The antenna has been disclosed both in "Microstrip-to-waveguide transition compatible with MM-wave integrated circuits," IEEE trans. Microwave Theory Tech., vol. 42, no.9,pp. 1842–1843, September 1994, written by W. Grapher, B. Hudler and W. Menzel, and "Waveguide-microstrip transmission line transition structure having an integral slot and antenna coupling arrangement," U.S. Pat. No. 5,793,263 1996, written by D. M. Pozar. The disclosures are incorporated herein by reference.
3. A microstrip probe made by using printed circuit board is inserted into the E-plane of the rectangular waveguide about a quarter of the wavelength in depth. Then, the ground plane of the microstrip probe is connected to the ground metal wall of the rectangular waveguide, thus achieving the mode conversion. The antenna has been disclosed in "Spectral-domain analysis of E-plane waveguide to microstrip transitions," IEEE Trans. Microwave Theory Tech., vol. 37, pp. 388–392, February 1989, written by T. Q. Ho, and Y. C. Shih, which is incorporated herein by reference.
4. A microstrip made by using printed circuit board is connected to a ridged waveguide, and full-wave analysis is performed to design an impedence matching circuit between the microstrip and the ridged waveguide so that the microstrip mode can be converted into the waveguide mode. The antenna has been disclosed in "A New Rectangular Waveguide to Coplanar Waveguide Transition," IEEE MTT-S Int. Microwave Symp. Dig., Dallsa, Tex., vol.1, pp.491–492, May 8–10, 1990, written by G. E. Ponchak and R. N. Simons, which is incorporated herein by reference.

As a conclusion drawn from the above, non-radiative dielectric guides, metal rectangular guides, with the aid of the transformation circuits are indeed able to demonstrate considerable outstanding low-loss characteristics. Nevertheless, all of the structures are three-dimensional instead of planar with complicated design, fabrication difficulty and expensive cost; these factors cause difficulties when interfaced with the planar printed circuit. In addition, due to different fabrication processes required by waveguide and planar printed circuits used, fabrication complexity issues arise during the construction of the entire circuit module. Consequently, it is laborious to make adjustments causing the production cost increase significantly and therefore inappropriate for mass production.

For the past few years, to captivate a larger communication market, wireless communication integrated circuits, which are light in weight with low profile and artistic in appearance, are prone to become the trend in the future.

However, as deduced from above, the main drawbacks of these mode converters currently available handicap the integrations of the integrated circuits since complicated fabrication processes are involved.

SUMMARY OF THE INVENTION

The invention relates to a planar mode converter used in a printed microwave integrated circuit; it includes a rectangular waveguide, a microstrip feed-in circuit and a microstrip feed-out circuit.

One object of the invention is to realize the feed-in/feed-out mode converter, the rectangular waveguide, and microstrip coupling in one unified fabrication process, and achieve mode conversion by utilizing electromagnetic coupling of the microstrip.

Another object of the invention is to utilize the feed-in/feed-out mode converter of the microstrip coupling to design and create a rectangular waveguide band filter.

The interior of the rectangular waveguide is filled with a plurality of dielectric layers which are closely adhered on top of one another, wherein the top surface of the uppermost layer, the bottom surface of the lowermost layer, and the right and left sides of the dielectric layers, are covered with metal materials. The lowermost dielectric layer usually has largest dielectric constant and thickness. Except for the lowermost dielectric layer, each dielectric layer has a rectangular aperture at its front-end and back-end, respectively. The rectangular apertures at the front-end are closely situated on top of another, and those of the back-end are also situated in the same manner.

The microstrip feed-in circuit is composed of a first metal strip, a second metal strip, a third metal strip and a feed-in metal ground plane. The first metal strip and the feed-in metal ground plane form a feed-in signal line, and the second metal strip is tapered in shape. The width of the first metal strip is the same as that of the narrow end of the second metal strip, and the narrow end of the second metal strip is connected with the first metal strip. The width of the third metal strip approximates to that of the rectangular waveguide, and the width of the third metal strip is the same as that of the wide end of the second metal strip. The wide end of the second metal strip is connected with one end of the third metal strip whose the other end extends partially into the front-end of the rectangular waveguide. Also, the extended third metal strip is situated closely on top of one another with the rectangular apertures at the front-end, and is electrically insulated from surrounding metal planes of the rectangular waveguide. The first metal strip, the second metal strip, and the third metal strip are adhered to the top surface of the lowermost dielectric layer, whereas the feed-in metal ground plane is adhered to the bottom surface of the lowermost dielectric layer.

The microstrip feed-out circuit is composed of a fourth metal strip, a fifth metal strip, a sixth metal strip, and a feed-out metal ground plane. The sixth metal strip and the feed-out metal ground plane form a feed-out signal line. The shape of the fourth metal strip is identical to that of the third metal strip, the shape of the fifth metal strip is identical to that of the second metal strip, and the shape of the sixth metal strip is identical to that of the first metal strip. The narrow end of the fifth metal strip is connected with the sixth metal strip, and the wide end of the fifth metal strip is connected with one end of the fourth metal strip whose the other end extends partially into the back-end of the rectangular waveguide. Also, the extended fourth metal strip is situated closely on top of one another with the rectangular apertures at the back-end, and is electrically insulated from surrounding metal planes of the rectangular waveguide. The fourth metal strip, the fifth metal strip, and the sixth metal strip are adhered to the top surface of the lowermost dielectric layer, whereas the feed-out metal ground plane is adhered to the bottom surface of the lowermost dielectric layer.

The advantages of the invention are as the following:

1. Relative to prior large and bulky mode converters, the planar mode converter of the invention is comparatively small in size with simple design and easy fabrication process.
2. By implementing a single unified fabrication process, in which a mode converter inclusive of feed-in/feed-out circuits and a rectangular waveguide can be formed, the mode converter thus has planar characteristics so that further integration with other microwave or millimeter wave integrated circuits can be accomplished more smoothly and compact. This then contributes to greater simplification in fabrication and lower production cost when designing multi-function radio-frequency modules.

BRIEF DESCRIPTION OF THE DRAWINGS

FIG. 6(*b*) shows the test results of the planar mode converter of the invention; the horizontal axis is the frequency in GHz, and the vertical axis is the transmission loss in dB.

FIG. 8(*b*) shows the test results of the frequency response of the waveguide bandpass filter shown in FIG. 7; the horizontal axis is the frequency in GHz, and the vertical axis is the transmission loss in dB.

DESCRIPTION OF THE PREFERRED EMBODIMENTS

Figure 1:
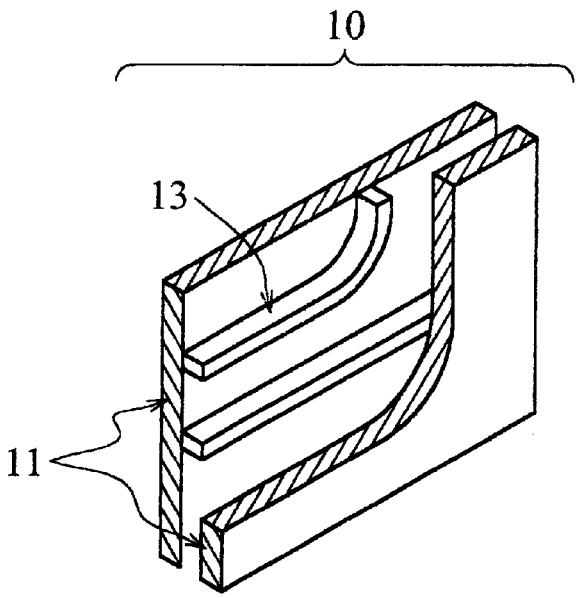
FIG. 1 shows the fundamental structure of a conventional non-radiative dielectric guide.
Figure 2:
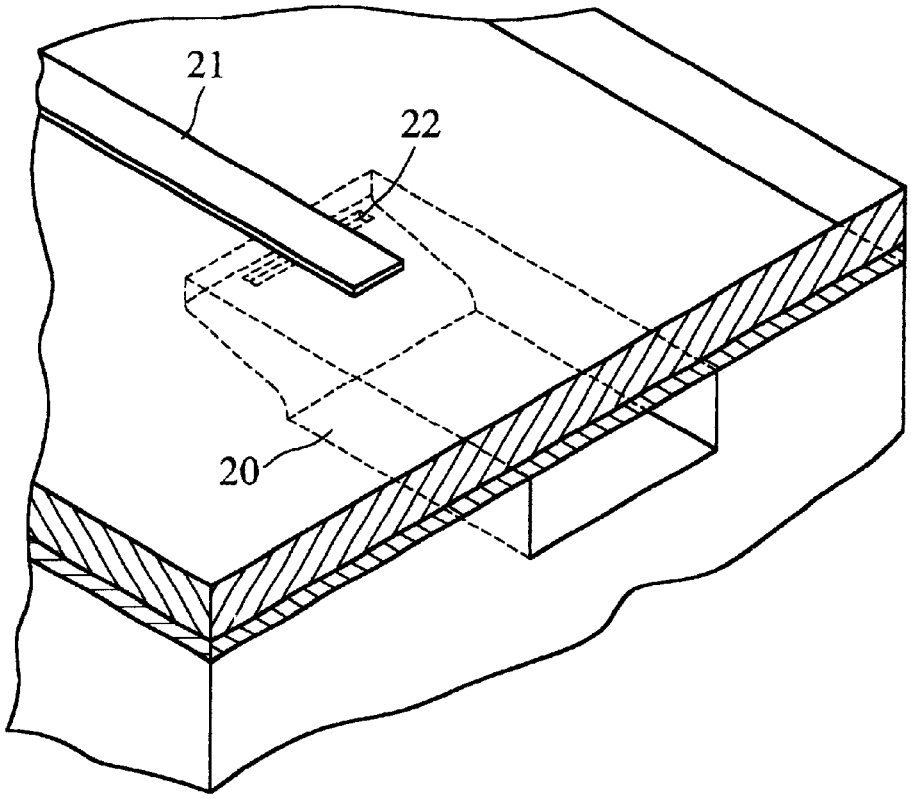
FIG. 2 shows a conventional waveguide and the mode converter structure thereof.
Figure 3:
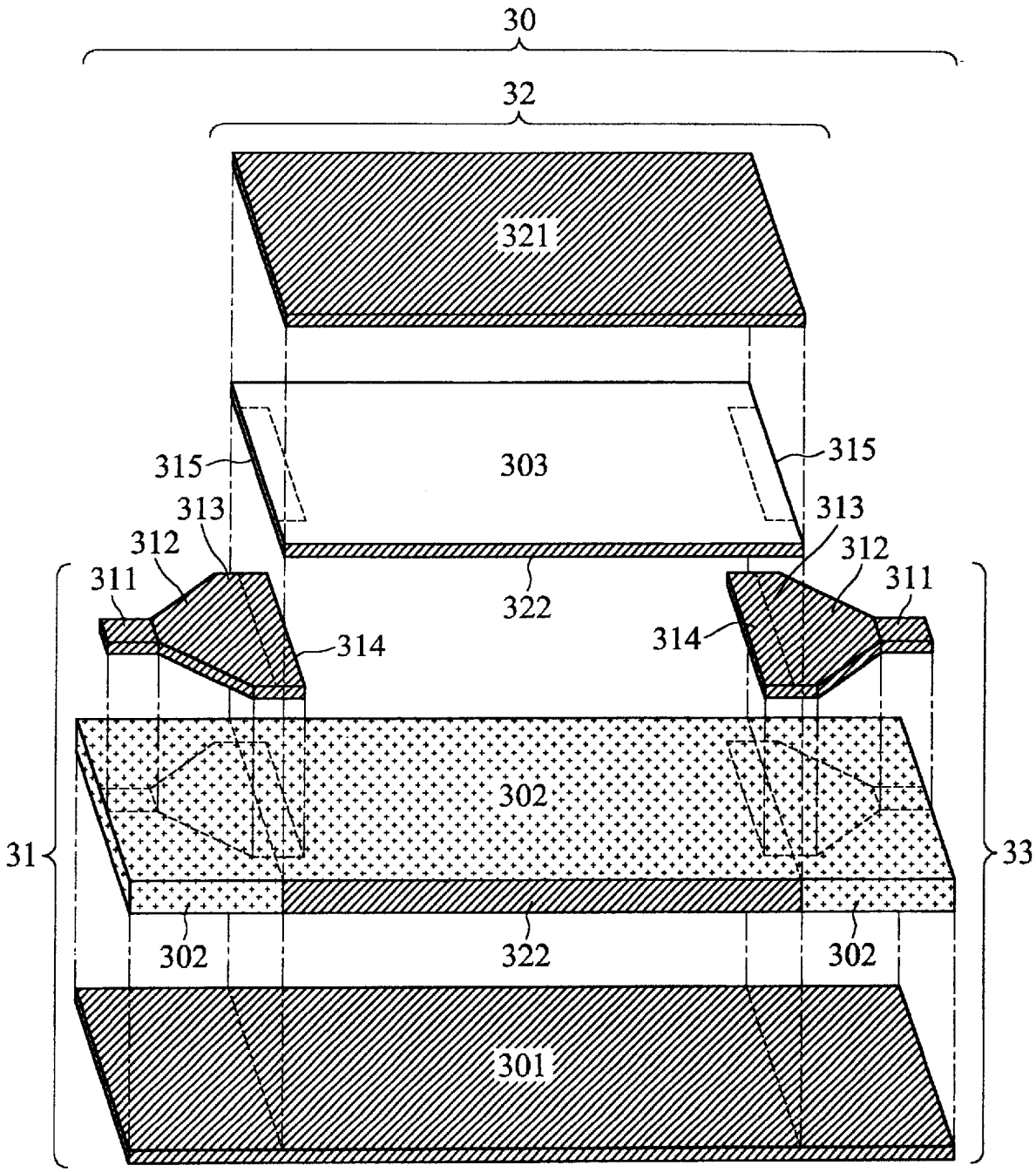
FIG. 3 is a schematic diagram of the planar mode converter of the invention.
Figure 4:
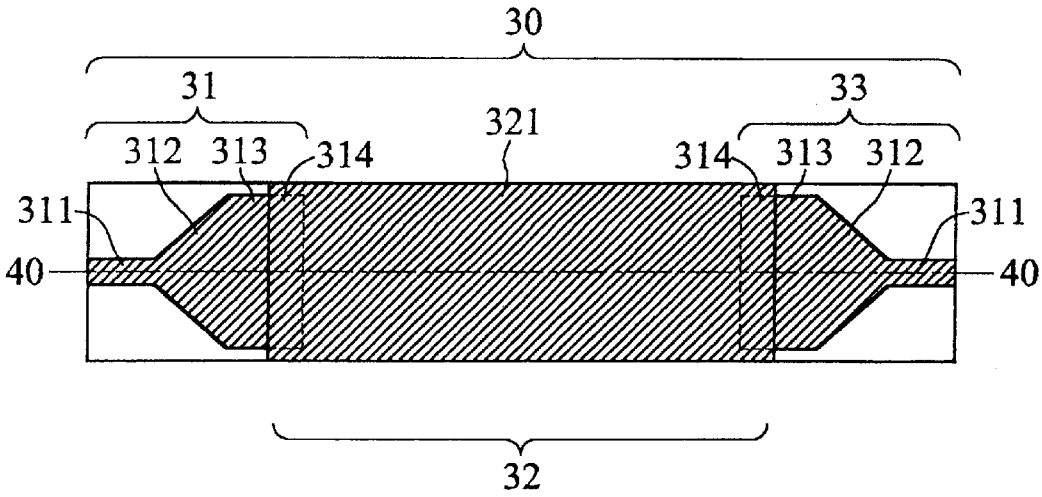
FIG. 4 is the top view of FIG. 3.
Figure 5:
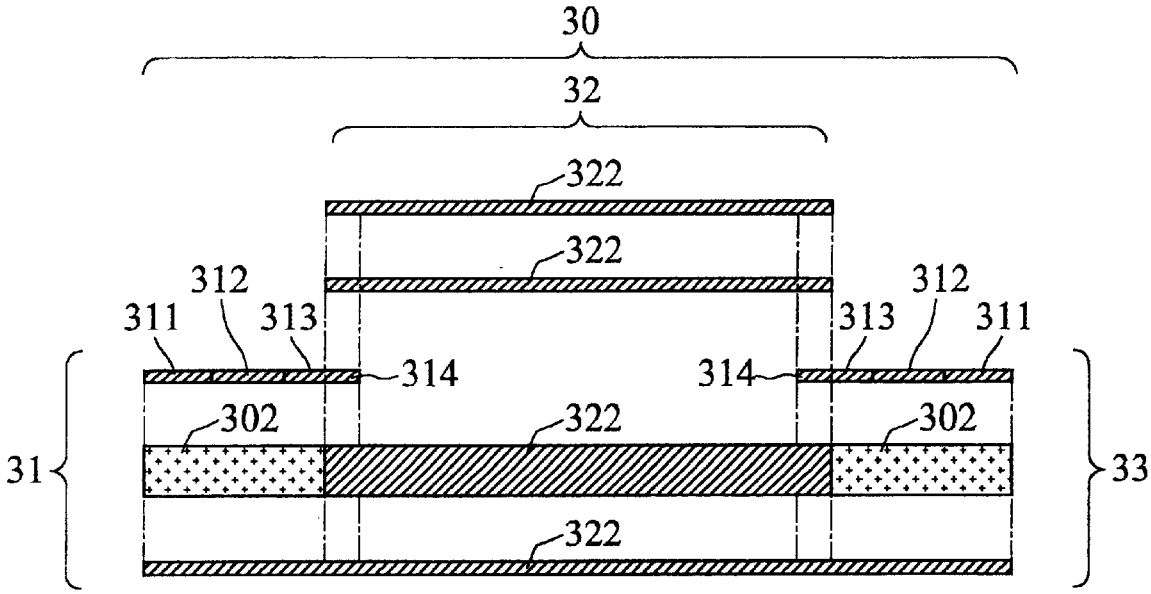
FIG. 5 is the side view of FIG. 3.

Referring to FIG. 3, the structure of the planar mode converter 30 fed-in by microstrip coupling is shown, including: (a) a microstrip feed-in circuit 31 and a microstrip feed-out circuit 33 having a metal ground plane 301; (b) a rectangular waveguide 32 filled by two dielectric layers 302 and 303. To illustrate more particularly by referring to FIGS. 3 and 5, the microstrip feed-in circuit 31 and the microstrip feed-out circuit 33 include an upper metal strip 311 of a typically 50Ω microstrip with a ground plane 301, an upper metal strip 312 of a gradually narrowing microstrip, an upper metal strip 313 of the microstrip, and an upper metal strip 314 of the microstrip extended into the rectangular waveguide 32. The rectangular waveguide 32 consists of two dielectric layers 302 and 303. The top surface of the dielectric layer 302 is adhered to the bottom surface of the dielectric layer 303; the top metal plane 321 covers the top surface of the dielectric layer 303, the bottom metal ground plane 301 covers the bottom surface of the dielectric layer 302; and side walls 322 on the right and left, respectively, are attached to the right and left sides of the dielectric layers 302 and 303. Referring to FIGS. 4 and 5, the microstrip feed-in circuit 31, the microstrip feed-out circuit 33 and the rectangular waveguide 32 are arranged along a propagation axis 40 of the guided wave, and are symmetric about axis as the centerline. The dielectric layers 302 and 303 can be filled with dielectric materials such as ceramic materials or fiberglass substrates. In addition, the upper metal strips 311, 312, 313, 314 and the metal ground plane 301 of the microstrip can be accurately adhered onto the dielectric layer 302 by employing conventional photographic etching or printing techniques with metal materials such as copper. Cover the top surface of the dielectric layer 303 with the top metal plane 321, and then adhere the dielectric layers 302 and 303, followed by using electrolysis electroplating to deposit metal materials, copper or gold for example, onto both sides of the dielectric layers 302 and 303, which are then adhered to the top metal plane 321 and the bottom ground metal plane 301, thus completing the entire structure of the mode converter.

Referring to FIGS. 4 and 5, the upper metal strips 311, 312, 313, and 314 of the microstrip are arranged along the propagation direction of the wave regarding the propagation axis 40 as the centerline, and share the dielectric layer 302 and the metal ground plane 301 with the rectangular waveguide 32. The upper metal strip 314 of the microstrip extends into the rectangular waveguide 32 at an appropriate length, with the dielectric layer 302 underneath it and the dielectric layer 303 on top of it. The upper metal strips 313 and 314 of the microstrip have the same width; the upper metal strip 311 of the microstrip and the metal ground plane 301 form a 50Ω signal input line; one end of the upper metal strip 311 of the tapered microstrip is connected with the upper metal strip 313 of the microstrip, and the other end connected with the upper metal strip 311 of the 50Ω microstrip, to serve as an impedance matching circuit.

In order to smoothly convert the microstrip mode into the dominant mode ($TE_{10}$) of the rectangular waveguide 32, and to reduce energy losses during the transmission, the width of the upper metal strips 313 and 314 depend on the width of the rectangular waveguide 32; and the dielectric layer 302 with typically larger thickness and dielectric constant is needed to fill the lower layer of the rectangular waveguide 32 so that most of the energy centralizes within the dielectric layer 302. Reversely, the dielectric layer 303 with typically smaller thickness and dielectric constant is needed to fill the upper layer of the rectangular waveguide 32 to minimize a radiative aperture 315 that causes the losses, and consequently reducing transmission efficiency. Furthermore, the upper metal strip 314 of the microstrip is not connected with the side walls 322 of the rectangular waveguide, for its width is typically slightly smaller than that of the rectangular waveguide 32, and the dielectric layer 303 separates the upper metal strip 314 from the top metal plane 321 of the rectangular waveguide 32. Therefore, the mode converter 30 has a direct-current blocking function.

FIG. 3 is also a schematic diagram of a mode converter at Ka frequency 26 to 40 GHz. The dielectric layers 302 and 303 are made of fiberglass, with thickness of 0.508 mm and a dielectric constant of 3.0 for the dielectric layer 302, and thickness of 0.0508 mm and relative dielectric constant of 2.1 for the dielectric layer 303. The rectangular waveguide 32 is 10 mm in length, 4.1 mm in width and 0.5588 mm in height, with the dielectric layer 302 filling on the bottom and the dielectric layer 303 filling the top. The upper metal strips 311, 312, 313 and 314, the metal ground plane 301, the right and left walls 322 and the top plane 321 of the rectangular waveguide 32 are made of copper. The upper metal strip 314 of the microstrip extended in between dielectric layers 302 and 303 and the upper metal strip 313 of the microstrip connected with the upper metal strip 314 are 3.4 mm in width and 0.7 mm in length. The upper metal strip 311 of the 50Ω microstrip at the signal input terminal is 1.2 mm in width and 2 mm in length, the upper metal strip 312 of the tapered microstrip is 3.3 mm in length, its one end connected with the upper metal strip 311 of the microstrip is 1.2 mm in width and the other end connected with the upper metal strip 313 of the microstrip is 3.4 mm in width, forming the impedance matching circuit.

Figure 6A:
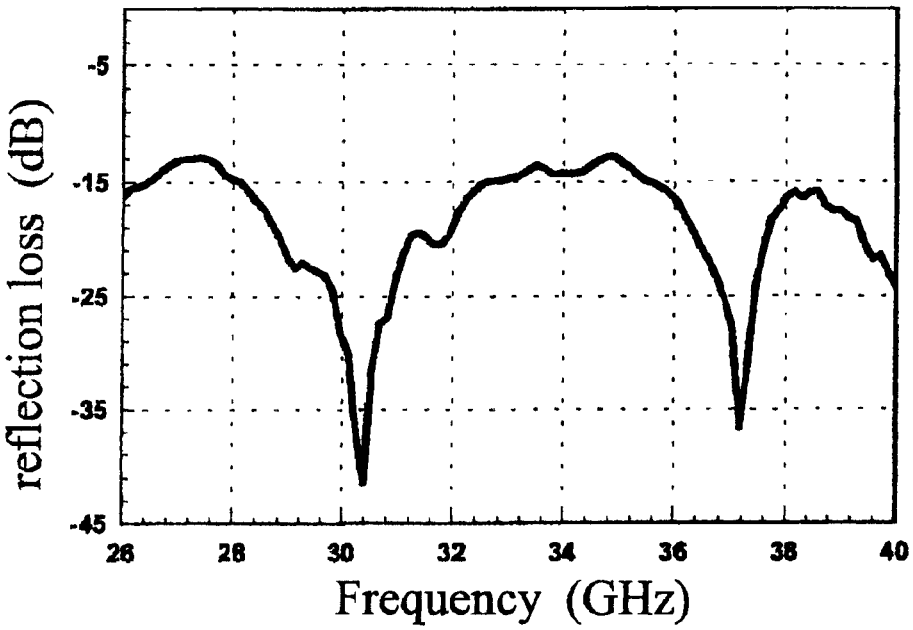
FIG. 6(*a*) shows the test results of the planar mode converter of the invention; the horizontal axis is the frequency in GHz, and the vertical axis is the reflection loss in dB.
Figure 6B:
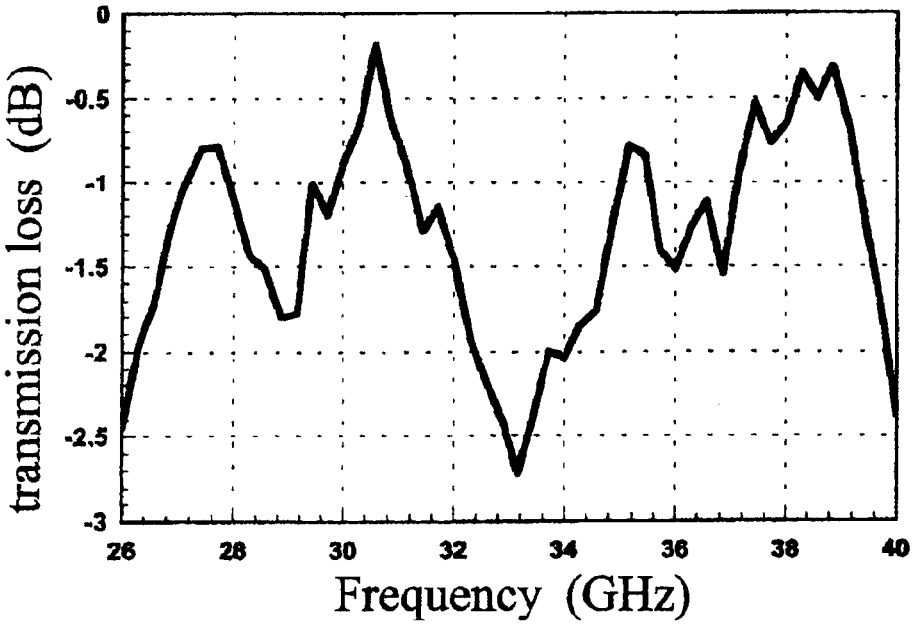

FIGS. 6(*a*) and 6(*b*) show the actual measurements of the dielectric multi-layer structure in FIG. 3. In FIG. 6(*a*), the horizontal axis is the frequency in GHz, and the vertical axis is the reflection loss in dB. In FIG. 6(*b*), the horizontal axis is the frequency in GHz, and the vertical axis is the transmission loss in dB. The measured results show that greater than 15 dB return losses for two-mode converters back-to-back connected by a rectangular waveguide using microstrip feeds has been achieved for nearly the entire Ka-band. The total transmission losses of the test structure have been kept lower than 2 dB for most frequencies of interest in the Ka-band.

Referring to FIGS. 3 to 6, it is observed that the mode converter 30 with the direct-current blocking function is an entirely planar structure including the microstrip feed-in circuit 31, the microstrip feed-out circuit 33, and the rectangular waveguide 32; all of the three can be completed by single printed circuit board (PCB) fabrication process, achieving a great convenience for making mode convert in an all-planner fashion. Comparing with prior techniques, the technique used in the invention is not only simple as far as its design and fabrication process are concerned, but the production cost is also significantly reduced because of its compatibility with the existing PCB process. Above all, the planar structure also favors the implementation of various applications of prior mode convert and waveguides onto printed circuit boards, as one of these applications, the waveguide bandpass filter 70, shown in FIG. 7.

Figure 7:
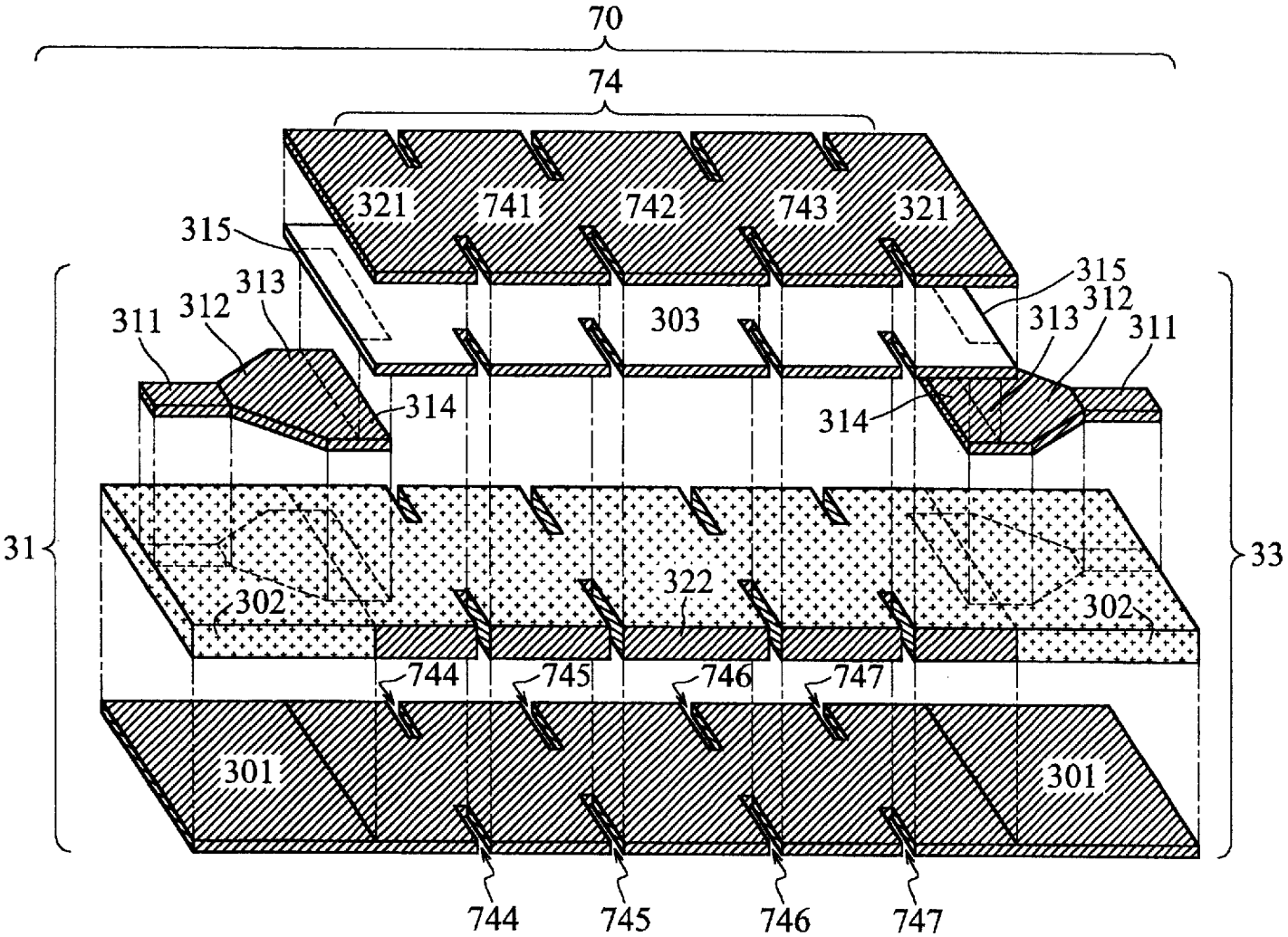
FIG. 7 shows the waveguide bandpass filter design by applying the planar mode converter of the invention.

Referring to FIG. 7, the waveguide bandpass filter 70 designed by implementing the planar mode converter of the invention is shown. The structure is composed of two different dielectric layers 302 and 303. The lower dielectric layer 302 has comparatively larger thickness and dielectric constant, whereas the upper dielectric layer 303 has comparatively smaller thickness and dielectric constant. The waveguide bandpass filter 70 includes a planar mode converter and a third-order Chebyshev rectangular waveguide bandpass filter 74. The planar mode converter is connected respectively with two ends of the waveguide bandpass filter 74 and centered along the propagation axis 40 (see FIG. 4). The waveguide bandpass filter 74 includes three rectangular waveguide resonators 741, 742, 743, and four pairs of metal-coated rectangular slits 744, 745, 746, and 747; all are distributed along the wave propagation axis 40 and symmetrical about the wave propagation axis 40 as the centerline. The upper, lower, right and left surfaces of all resonators are covered with metal conductors 321, 301, and 322. All rectangular waveguide resonators respectively have one open aperture at the front-end and one at the back-end, as to allow energy coupling to adjacent resonators or waveguides.

Control of dimensions of slits 744, 745, 746 and 747 together with proper sizes of resonators 741, 742 and 743 leads to design of all-planar PCB filter with desirable bandwidth and stopband rejection.

Figure 8A:
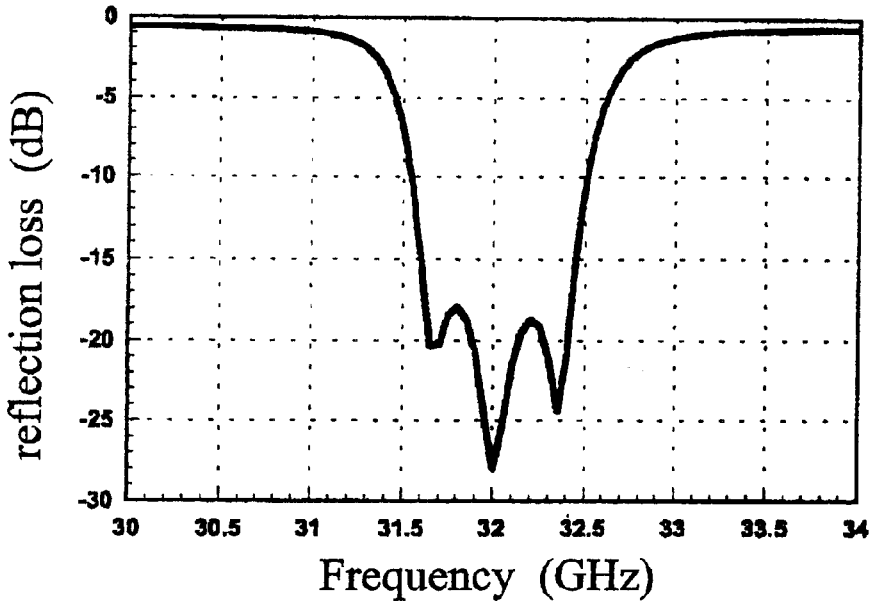
FIG. 8(*a*) shows the test results of the frequency response of the waveguide bandpass filter shown in FIG. 7; the horizontal axis is the frequency in GHz, and the vertical axis is the reflection loss in dB.
Figure 8B:
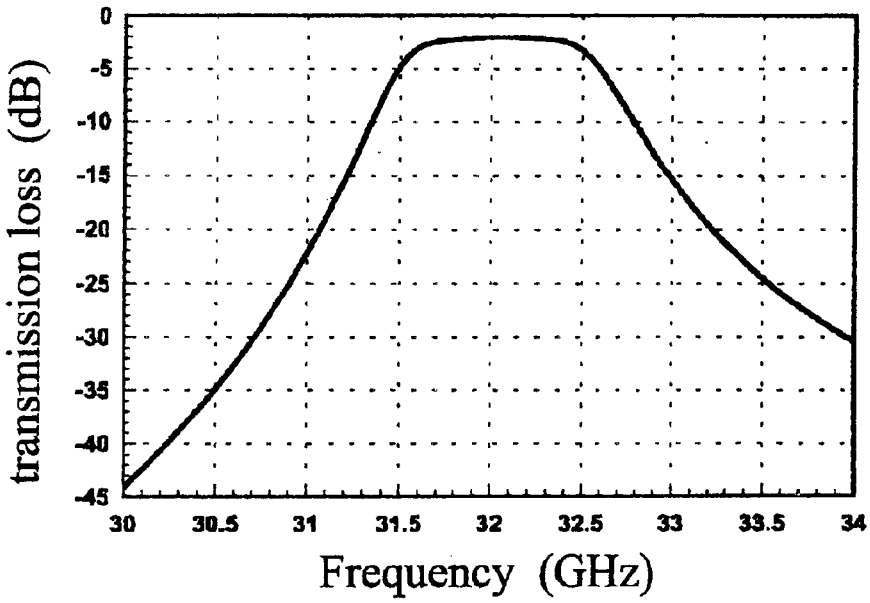

FIGS. 8(*a*) and 8(*b*) show the theoretical frequency response of the waveguide bandpass filter structure shown in FIG. 7 using full-wave finite-element-method program HFSS™(High Frequency Structure Simulator is the trade mark of AnSoft). In FIG. 8(*a*), the horizontal axis is the frequency in GHz, and the vertical axis is the reflection loss in dB; in FIG. 8(*b*), the horizontal axis is the frequency in GHz, and the vertical axis is the transmission loss in dB. During the full-wave analyses, loss tangent of 0.002 for dielectric filling 322 and 0.003 for dielectric filling 323, and conductivity of $5.8\times10^7$ /m are included to account for material losses. The simulated results show that a 31.5-to-32.5 GHz bandpass filter can be realized in an all-planar fashion with return losses larger than 10 dB and transmission losses nearly 2 dB in the passband and more than 40 dB rejection at low side 1.5 GHz away from low-corner passband. Thus, a high-performance bandpass filter is realizable using printed circuit board approach.

Figure 9:
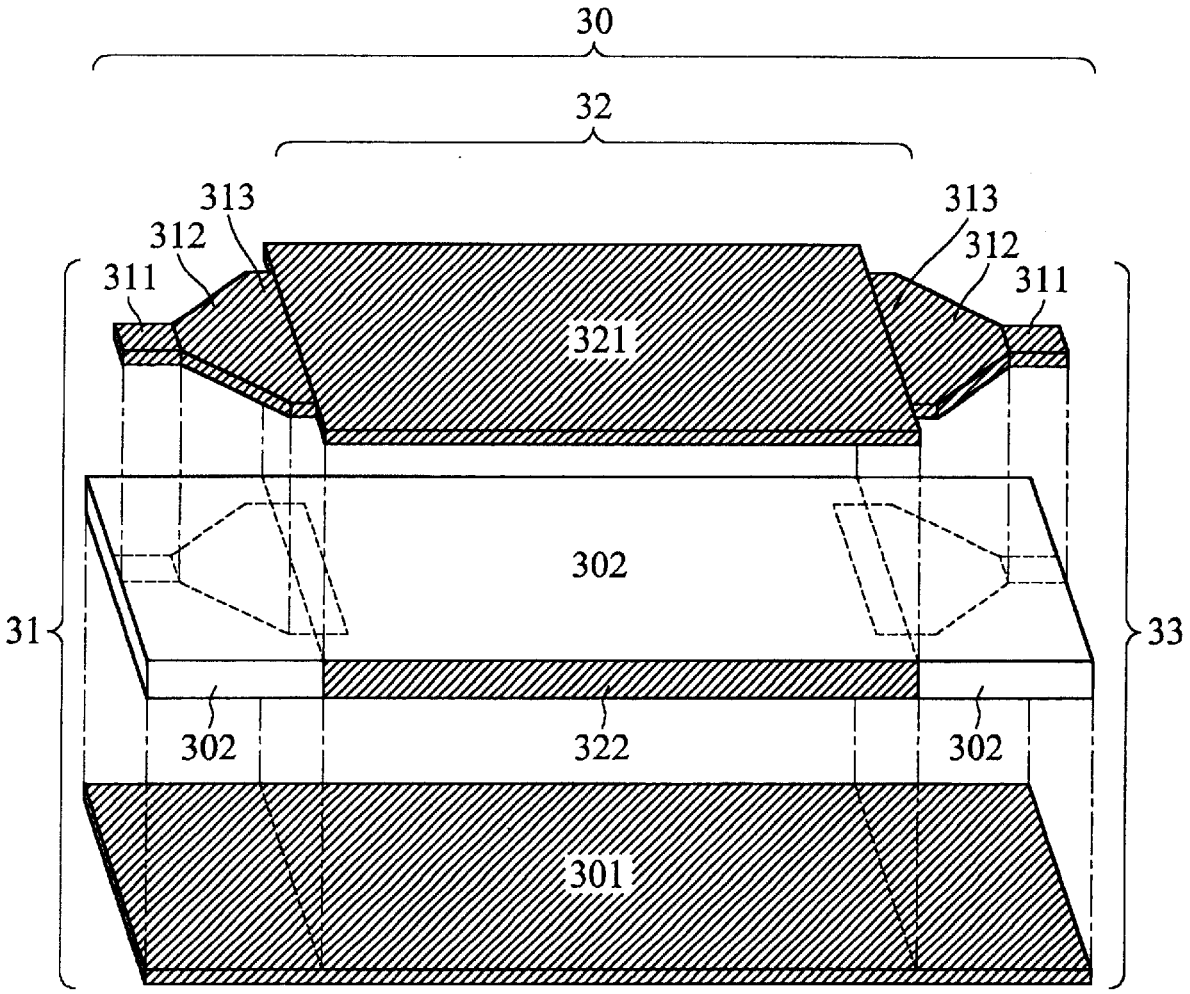
FIG. 9 shows DC-shorted planar mode converter of the invention.

FIG. 9 has the same reference numerals with FIG. 3. Removing the dielectric layer 303 and coalescing the top metal plate 32 and the feed-in/feed-out plates 311-312-313, FIG. 3 is reduced to FIG. 9, showing a DC-shorted version of back-to-back, connected planar microstrip-to-waveguide mode converters.

The mode converters are fabricated using RO4003™ (RO4003™ is the trade mark of Rogers corporation) dielectric substrate of thickness 0.508 mm, loss tangent 0.002, and metal thickness 17 $\mu$m of conductivity $5.8\times10^7$ S/m. The rectangular waveguide is of 4.1 mm in width and 0.508 mm in height. 50Ω microstrip is of 1.2 mm wide and tapered to 1.6 mm before connecting the microstrip taperer to the rectangular waveguide.

Figure 10:
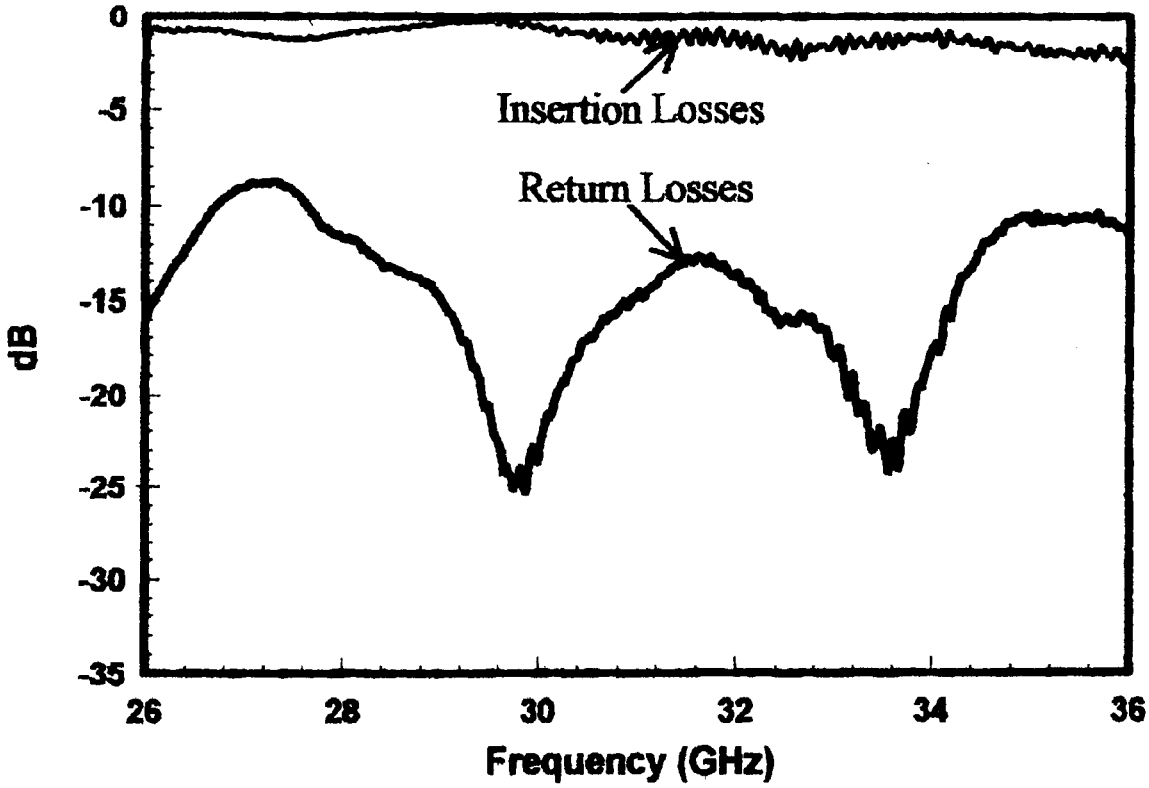
FIG. 10 shows measured results of the DC-shorted planar mode converter of the invention.

FIG. 10 plots the measured reflection and transmission coefficients of Ka-band mode converters connected back-to-back as shown in FIG. 9. Excellent measured results are obtained, showing about 1 dB insertion losses and the minimum insertion loss approximately 0.3 dB near 30 GHz.

The specific description and examples of the aforesaid preferred embodiments are only illustrative and are not to be construed as limiting the invention. Various modifications can be made without departing from the true spirit and scope of the invention as defined by the appended claims. For example, the interior of the rectangular waveguide may be filled with more dielectric layers, depending on the practical requirements.

What is claimed is:

1. A planar mode converter used in printed microwave integrated circuits comprising:

a rectangular waveguide, with its interior filled with a plurality of dielectric layers, which are closely situated on top of one another; wherein a top surface of an uppermost dielectric layer, a bottom surface of a lowermost dielectric layer, and right and left sides of said plurality of dielectric layers, are covered with metal materials; said lowermost dielectric layer has largest thickness and dielectric constant; except for the lowermost dielectric layer, each of said plurality of dielectric layers has a rectangular aperture at its front-end and one at its back-end, respectively; said rectangular apertures at the front-end are closely situated on top of one another, and said rectangular apertures at the back-end are closely situated on top of one another;

a microstrip feed-in circuit constituted by a first metal strip, a second metal strip, a third metal strip, and a feed-in metal ground plane; wherein said first metal strip and said feed-in metal ground plane form a feed-in signal line; said second metal strip is tapered in shape; a width of said first metal strip is the same as that of a narrow end of said second metal strip, and the narrow end of said second metal strip is connected with said first metal strip; a width of said third metal strip approximates to that of said rectangular waveguide, and is the same as that of a wide end of said second metal strip; the wide end of said second metal strip is connected with one end of said third metal strip whose the other end partially extends into the front-end of said rectangular waveguide; said third metal strip extended is situated closely on top of one another with said rectangular apertures at the front-end and is electrically insulated from surrounding metal planes of said rectangular waveguide; said first metal strip, said second metal strip, and said third metal strip are adhered to a top surface of said lowermost dielectric layer, and said feed-in metal ground plane is adhered to the bottom surface of said lowermost dielectric layer; and a microstrip feed-out circuit constituted of a fourth metal strip, a fifth metal strip, a sixth metal strip, and a feed-out metal ground plane; wherein said sixth metal strip and said feed-out metal strip form a feed-out signal line; the shape of said fourth metal strip is identical to that of said third metal strip, the shape of said fifth metal strip is identical to that of said second metal strip, and the shape of said sixth metal strip is identical to that of said first metal strip; a narrow end of said fifth metal strip is connected with said sixth metal strip, and a wide end of said fifth metal strip is connected with one end of the fourth metal strip whose other end extends partially into a back-end of said rectangular waveguide; said fourth metal strip extended is situated closely on top of one another with said rectangular apertures at the back-end and is electrically insulated from all surrounding metal planes of said rectangular waveguide; said fourth metal strip, said fifth metal strip, and said sixth metal strip are adhered to the top surface of said lowermost dielectric layer and said feed-out metal ground plane is adhered to the bottom surface of said lowermost dielectric layer.

2. The planar mode converter as described in claim 1, wherein the number of said plurality of dielectric layers is two.

3. The planar mode converter as described in claim 2, wherein said lowermost dielectric layer is made of fiberglass.

4. The planar mode converter as described in claim 2, wherein said lowermost dielectric layer is made of ferrite.

5. The planar mode converter as described in claim 3, wherein the surrounding metal planes of said rectangular waveguide, the metal strips forming said microstrip feed-in circuit and said microstrip feed-out circuit, and the metal ground plane, are made of gold.

6. The planar mode converter as described in claim 3, wherein the surrounding metal planes of said rectangular waveguide, the metal strips forming said microstrip feed-in circuit and said microstrip feed-out circuit, and the metal ground plane, are made of silver.

7. The planar mode converter as described in claim 3, wherein the surrounding metal planes of said rectangular waveguide, the metal strips forming said microstrip feed-in circuit and said microstrip feed-out circuit, and the metal ground plane, are made of copper.

8. The planar mode converter as described in claim 4, wherein the surrounding metal planes of said rectangular waveguide, the metal strips forming said microstrip feed-in circuit and said microstrip feed-out circuit, and the metal ground plane, are made of gold.

9. The planar mode converter as described in claim 4, wherein the surrounding metal planes of said rectangular waveguide, the metal strips forming said microstrip feed-in circuit and said microstrip feed-out circuit, and the metal ground plane, are made of silver.

10. The planar mode converter as described in claim 4, wherein the surrounding metal planes of said rectangular waveguide, the metal strips forming said microstrip feed-in circuit and said microstrip feed-out circuit, and the metal ground plane, are made of copper.

11. A waveguide bandpass filter used in printed microwave integrated circuits comprising:

a rectangular waveguide, with its interior filled with a plurality of dielectric layers, which are closely situated on top of one another; a top surface of an uppermost dielectric layer, a bottom surface of a lowermost dielectric layer, and right and left sides of said respective layers, are covered with metal materials; each of said plurality of dielectric layers has N pairs of symmetrical metal-coated rectangular slits at right and left sides, where N is an integer greater than or equal to 2; said N pairs of symmetrical metal-coated rectangular slits are situated on top of one another and are not connected at front or back ends nor at right or left sides, and the surfaces thereof are covered with metal materials; the lowermost dielectric layer has largest dielectric constant and thickness; except for the lowermost dielectric layer, each of said plurality of dielectric layers has a rectangular aperture at its front-end and one at its back-end, respectively; the rectangular apertures at said front-end are situated closely on top of one another, and the rectangular apertures at said back-end are situated closely on top of one another; said N pairs of symmetrical metal-coated rectangular slits are not connected with said rectangular apertures at the front-end and the back-end;

a microstrip feed-in circuit constituted by a first metal strip, a second metal strip, a third metal strip, and a feed-in metal ground plane; wherein said first metal strip and said feed-in metal ground plane form a feed-in signal line; said second metal strip is tapered in shape, a width of said first metal strip is the same as that of a narrow end of said second metal strip, and the narrow end of said second metal strip is connected with said first metal strip; a width of said third metal strip approximates to that of said rectangular waveguide, and is the same as that of a wide end of said second metal strip; the wide end of said second metal strip is connected with one end of said third metal strip whose the other end partially extends into the front-end of said rectangular waveguide; said third metal strip extended is situated closely on top of one another with said respective front-end apertures and is electrically insulated from all surrounding metal planes of said rectangular waveguide; said first metal strip, said second metal strip, and said third metal strip are adhered to a top surface of said lowermost dielectric layer, and said feed-in metal ground plane is adhered to the bottom surface of said lowermost dielectric layer; and a microstrip feed-out circuit constituted of a fourth metal strip, a fifth metal strip, a sixth metal strip, and a feed-out metal ground plane; wherein said sixth metal strip and said feed-out metal strip form a feed-out signal line; the shape of said fourth metal strip is identical to that of said third metal strip, the shape of said fifth metal strip is identical to that of said second metal strip, and the shape of said sixth metal strip is identical to that of said first metal strip; a narrow end of said fifth metal strip is connected with said sixth metal strip, and a wide end of said fifth metal strip is connected with one end of the fourth metal strip whose other end extends partially into the back-end of said rectangular waveguide; said fourth metal strip extended is situated closely on top of one another with rectangular apertures at the back-end and is electrically insulated from surrounding metal planes of said rectangular waveguide; said fourth metal strip, said fifth metal strip, and said sixth metal strip are adhered to the top surface of said lowermost dielectric layer and said feed-out metal ground plane is adhered to the bottom surface of said lowermost dielectric layer.

12. The waveguide bandpass filter as described in claim 11, wherein the number of said plurality of dielectric layers is 2.

13. The waveguide bandpass filter as described in claim 12, wherein the value of N is 4.

14. The waveguide bandpass filter as described in claim 13, wherein the lowermost dielectric layer is made of fiberglass.

15. The waveguide bandpass filter as described in claim 13, wherein the lowermost dielectric layer is made of ferrite.

16. The waveguide bandpass filter as described in claim 14, wherein the surrounding metal planes of said rectangular waveguide, the metal strips forming said microstrip feed-in circuit and said microstrip feed-out circuit, and the metal ground plane, are made of gold.

17. The waveguide bandpass filter as described in claim 14, wherein the surrounding metal planes of said rectangular waveguide, the metal strips forming said microstrip feed-in circuit and said microstrip feed-out circuit, and the metal ground plane, are made of silver.

18. The waveguide bandpass filter as described in claim 14, wherein the surrounding metal planes of said rectangular waveguide, the metal strips forming said microstrip feed-in circuit and said microstrip feed-out circuit, and the metal ground plane, are made of copper.

19. The waveguide bandpass filter as described in claim 15, wherein the surrounding metal planes of said rectangular waveguide, the metal strips forming said microstrip feed-in circuit and said microstrip feed-out circuit, and the metal ground plane, are made of gold.

20. The waveguide bandpass filter as described in claim 15, wherein the surrounding metal planes of said rectangular waveguide, the metal strips forming said microstrip feed-in circuit and said microstrip feed-out circuit, and the metal ground plane, are made of silver.

21. The waveguide bandpass filter as described in claim 15, wherein the surrounding metal planes of said rectangular waveguide, the metal strips forming said microstrip feed-in circuit and said microstrip feed-out circuit, and the metal ground plane, are made of copper.

* * * * *